United States Patent [19]

Bartels

[11] Patent Number: 4,672,333

[45] Date of Patent: Jun. 9, 1987

[54] WAVEGUIDE JUNCTION CIRCULATOR

[75] Inventor: Stefan Bartels, Senden, Fed. Rep. of Germany

[73] Assignee: Licentia Patent-Verwaltungs-GmbH, Fed. Rep. of Germany

[21] Appl. No.: 786,941

[22] Filed: Oct. 11, 1985

[30] Foreign Application Priority Data

Nov. 13, 1984 [DE] Fed. Rep. of Germany ..... 3441352

[51] Int. Cl.[4] ..... H01P 1/39

[52] U.S. Cl. ..... 333/1.1; 333/125

[58] Field of Search ..... 333/1.1

[56] References Cited

U.S. PATENT DOCUMENTS

| | | | |
|---|---|---|---|
| 3,617,950 | 11/1971 | Barnes et al. | 333/1.1 |
| 3,714,608 | 1/1973 | Barnes et al. | 333/1.1 |
| 4,145,672 | 3/1979 | Piotrowski | 333/1.1 |
| 4,240,049 | 12/1980 | Kostelnick | 333/1.1 |

*Primary Examiner*—Paul Gensler

*Attorney, Agent, or Firm*—McGlew and Tuttle

[57] ABSTRACT

A waveguide circulator includes a resonator body which is separated from a waveguide side by a dielectric spacer disc. The spacer disc has an interface turned toward the waveguide side in which defined electromagnetic boundary conditions are to prevail. The thickness of the spacer disc and the dielectric constant of the disc material are matched so that the disc thickness equals a quarter wavelength, referred to a wave propagating in the disc perpendicular to the waveguide side.

5 Claims, 2 Drawing Figures

WAVEGUIDE JUNCTION CIRCULATOR

FIELD AND BACKGROUND OF THE INVENTION

This invention relates in general to waveguide or waveguide junction circulators and in particular to a new and useful waveguide junction circulator having a resonator body disposed between two parallel waveguide sides.

Essential for the functioning of such waveguide circulators is the exact matching of the resonance body, which comprises a ferrimagnetic material, to the operating frequency of the circulator and to the chosen oscillation mode. The resonance body must occupy a certain position within the circulator branching, and at the interfaces of the circulator certain electromagnetic boundary conditions should prevail.

For the adjustment of such circulators there are known thus far such measures as impedance transformation by reducing the waveguide height and insertion of ceramic pieces into the waveguide arms, but often this constitutes a not very satisfactory and an expensive solution.

SUMMARY OF THE INVENTION

The invention provides a design of waveguide junction circulator which ensures optimum functioning by the presetting of optimum bondary conditions. The waveguide junction circulator can be manufactured in a simple and cost-efficient manner.

In accordance with the invention a waveguide circulator comprises two spaced apart waveguide bases defining parallel waveguide sides. The resonator body is disposed between the two parallel waveguide sides and a dielectric disc fixes and insulates the resonator body at least against one of the two waveguide sides. The thickness of the dielectric disc and the dielectric constant of the dielectric disc material are matched in the way that the disc thickness equals a quarter wavelength or an integral multiple thereof as referred to a wave propagating in the disc perpendicular to the waveguide bases at the operating of the frequency of the waveguide circulator.

In the arrangement according to the invention, the electrical shortcircuit on the waveguide side is transformed to the boundary condition stipulated for the face of the resonator body turned toward this waveguide side. For the transformation from the shortcircuit on the waveguide base to no load or open circuit condition, the thickness of the discs should be made equal to a quarter wavelength or an odd multiple thereof, and for the transformation to short circuit condition the thickness of the discs should be made equal to an even multiple of a quarter wavelength in analogy to the transmission line theory.

As reference for this quarter wavelength should be used the wavelength of a wave assumed to be propagating perpendicular to the waveguide sides in the dielectric disc or respectively to be forming a standing wave between the waveguide sides at the operating frequency, or, in the case of an operating frequency band, at the mean operating frequency of the waveguide circulator. The mode of this wave is given by the resonator body. The wavelength of such a wave in the waveguide arrangement equals, in a first approximation, the free space wavelength reduced by a factor of $1/\sqrt{\text{epsilon}_r}$, $\text{epsilon}_r$ being the relative dielectric constant of the disc material. There may be a generally minor influence of the wavelength resulting from the lateral enveloping edge of the propagation or resonance space.

Often the waveguide height as the distance between the opposite sides is given by the system as a whole, and the dimensions of the resonator body disposed in the waveguides are fixed by its mode of operation, so that this already determines the thickness of the spacer discs. For optimum adaptation according to the idea of the invention there remains, as a free parameter, the material of the discs, which with respect to its dielectric constant is selected so that at a given operating frequency and disc thickness the quarter wavelength condition is fulfilled.

Accordingly it is an object of the invention to provide an improved waveguide circulator in which the thickness of a dielectric disc and a dielectric constant of the disc material is matched so that disc thickness equals a quarter wavelength or a multiple thereof.

A further object of the invention is to provide a waveguide circulator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREPERRED EMBODIMENT

Figure 1:
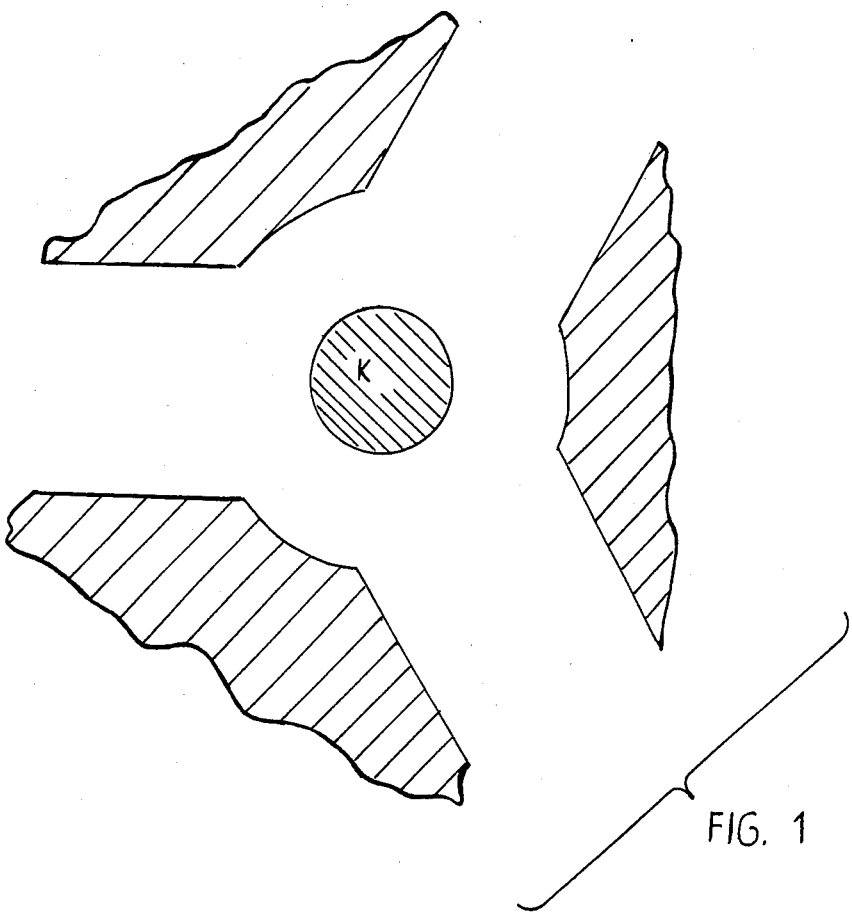
FIG. 1 is a plan view of a circulator arrangement constructed in accordance with the invention.
Figure 2:
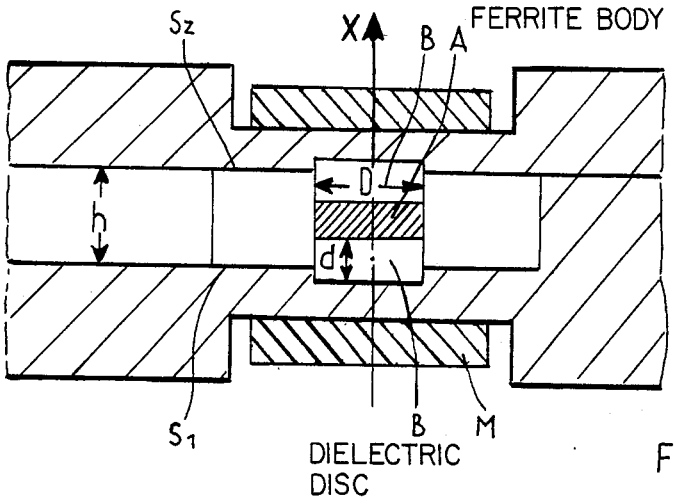
FIG. 2 is a side elevational view of the arrangement shown in FIG. 1.

Referring to the drawings in particular the invention embodied therein comprises a waveguide junction circulator which comprises two spaced apart waveguide bases or sides S1 and S2. The dielectric disc B fixes and insulates the resonator body at least in respect to one of the waveguide sides. The thickness d of the disc B and the dielectric constant of the dielectric disc material is matched so that the disc thickness equals a quarter length wavelength or an integral multiple thereof and is referred to a wave propagation in the disc perpendicular to the waveguide bases S1 and S2 at the operating frequency of the waveguide circulator.

The waveguide construction of the circulator comprises a Y-waveguide branch which has been expanded to a circular cavity resonator (FIG. 1). In the center of the branching a circular-cylindrical body K is arranged, which is composed of a ferrite resonator body A and two dielectric spacer discs B. The discs B have the same diameter D as the ferrite body A, so that there results a uniform generated surface of the body K, and they are glued to the ferrite body. By the discs the ferrite body is held in its position between bottom S1 and cover S2 of the cavity at the height h. The cylindrical body is fitted into flat (shallow) blind holes in the waveguide sides, being thus fixed in the center of the branching in an advantageous manner. The permanent magnets M produce the static magnetic field for the circulator action.

In its dimension the ferrite body is to be adjusted to those resonance oscillation modes which require as boundary conditions magnetic interfaces on both faces turned toward the waveguide sides S1, S2, i.e. electrical noload, for example the modes corresponding to a $H_{011}$- and/or $H_{211}$-mode in the cavity resonator with electrically conducting limiting faces in the ferrite body as a dielectric resonator. To transform the electrical shorcircuit at the bottom and cover of the waveguide into electrical noload corresponding to a magnetic wall on the surface of the ferrite body, the thickness d of the discs B is made equal to a quarter wavelength. The length to be considered is the length of that wave which propagates in the discs perpendicular to the parallel waveguide sides S1, S2, that is, in the x-direction, or which forms a standing wave between the bottom S1 and cover S2. This wavelength results from the wavelength of the empty cavity resonator by reduction by a factor of $1/\sqrt{\text{epsilon}_r}$, $\text{epsilon}_r$ being the relative dielectric constant of the dielectric spacer discs.

While a specific embodiment of the invention has been shown and described in detail to illustrate the application of the principles of the invention, it will be understood that the invention may be embodied otherwise without departing from such principles.

What is claimed is:

1. A waveguide junction circulator comprising two spaced apart waveguide bases defining parallel waveguide sides, a resonator body of ferrite material disposed between said two parallel waveguide sides, a dielectric disc fixing and insulating said resonator body at least against one of said two waveguide sides, the thickness of said dielectric disc and the dielectric constant of said dielectric disc material being matched so that the disc thickness equals a quarter wavelength or an integral multiple thereof referred to a wave propagating in said disc perpendicular to said waveguide bases at the operating frequency of the waveguide circulator, and magnet means for establishing a magnetic field between said waveguide sides at said resonator body.

2. A waveguide junction circulator according to claim 1, wherein said resonator body and said disc form a cylindrical body with a uniform generated surface.

3. A waveguide junction circulator according to claim 1, including adhesive securing said disc to said resonator body.

4. A waveguide junction circulator according to claim 1, wherein said waveguide bases includes a waveguide side having a blind hole fixing said disc therein.

5. A waveguide junction circulator according to claim 1 wherein said resonator body is separated from said waveguide sides and including a dielectric disc between said waveguide body and each respective side.

* * * * *